US007121314B2

(12) United States Patent
Hicks et al.

(10) Patent No.: US 7,121,314 B2
(45) Date of Patent: Oct. 17, 2006

(54) PATIO AWNING LOCK MECHANISM

(75) Inventors: Mike Hicks, El Paso, TX (US); Roberto Gutierrez, El Paso, TX (US); Brandon Moore, Las Cruces, NM (US); Thomas Hanson, Las Cruces, NM (US)

(73) Assignee: Dometic Corporation, Elkhart, IN (US)

( * ) Notice: Subject to any disclaimer, the term of this patent is extended or adjusted under 35 U.S.C. 154(b) by 156 days.

(21) Appl. No.: 10/821,361

(22) Filed: Apr. 9, 2004

(65) Prior Publication Data

US 2005/0224187 A1 Oct. 13, 2005

(51) Int. Cl.
*E04F 10/00* (2006.01)

(52) U.S. Cl. ..... 160/22; 160/67

(58) Field of Classification Search ..... 160/298, 160/291, 299, 66, 67, 73, 81, 22, 301, 302, 160/303, 29, 30; 248/229.1, 229.12, 229.17, 248/229.22

See application file for complete search history.

(56) References Cited

U.S. PATENT DOCUMENTS 4,607,654 A * 8/1986 Duda ..... 135/88.12
4,658,877 A 4/1987 Quinn
4,759,396 A 7/1988 Quinn
4,770,223 A 9/1988 Ouellette
4,819,706 A 4/1989 Quinn
5,732,756 A * 3/1998 Malott ..... 160/67
5,752,536 A 5/1998 Becker
5,819,830 A * 10/1998 Verelst ..... 160/22
5,848,629 A * 12/1998 Baka ..... 160/67
6,089,306 A 7/2000 Frey, Jr.
6,206,078 B1 * 3/2001 Frey, Jr. ..... 160/302
6,792,993 B1 * 9/2004 Forbes ..... 160/67

* cited by examiner

*Primary Examiner*—Blair M. Johnson
(74) *Attorney, Agent, or Firm*—Pearne & Gordon LLP

(57) ABSTRACT

An awning assembly is provided with a lock mechanism for maintaining the awning assembly in a desired position relative to a wall, or other suitable structure. The awning assembly includes support arms, a fabric roller tube that holds the awning fabric and a lock mechanism. The lock mechanism can include a pivot bracket located between the roller tube and the support arm, a disk gear provided on the end of the roller tube axle, a weather shield provided around at least a portion of the roller tube, a pivot rod selectably engageable with both the pivot bracket and the weather shield, a disk gear catch mounted on the weather shield and adapted to be selectably engaged with the disk gear, and a torsion spring mounted on the weather shield and adapted to bias the disk gear catch into engagement with the disk gear.

23 Claims, 4 Drawing Sheets

PATIO AWNING LOCK MECHANISM

FIELD OF THE INVENTION

The present invention relates to retractable awning assemblies, and more particularly to a lock mechanism for a retractable awning assembly.

DESCRIPTION OF THE RELATED ART

There are a number of known retractable awning assemblies that support an awning to create a sheltered area. Such awning assemblies have been designed for use on mobile structures such as, for example, recreational vehicles and mobile homes. When the awning assembly is mounted on a mobile vehicle and stored in a retracted position, wind currents and other movements caused by the moving vehicle can move the awning assembly from the retracted position to an extended position by unfurling the awning or canopy portion of the awning assembly. When the awning assembly is used in an extended position, wind currents and the like can also tend to move the awning toward a retracted position and can sometimes make it difficult to maintain the awning in a fully extended position. Accordingly, the awning assemblies must have lock systems for retaining the awning in either the retracted position or the extended position.

Most modern awning assemblies have a roller mounted on an end of a pair of support arms so as to be moved between retracted and extended positions. The awning is adapted to be furled or wrapped around the roller as it is moved from the extended position to the retracted position. When moving the awning assemblies, particularly large awning assemblies, it is desirable to control movement of the roller by permitting rotation of the roller in only one direction at a time. The required direction depends on whether the awning is being retracted or extended.

Many lock assemblies have been designed for controlling and/or preventing movement of the roller. While these prior lock assemblies may be somewhat effective, they tend to be difficult to operate and are particularly difficult to operate when at remote locations. Some lock assemblies rotate with the roller and can end up out of the reach and/or the view of the operator. Other lock assemblies require complicated mechanisms or movements that are difficult to operate when the lock assembly is out of the reach and/or out of the view of the operator. For example, conventional patio awnings require a cam that must be toggled to open or extend the awning. Most lock assemblies operate to prevent rotation of the roller in one direction or the other but cannot fully lock the awning against rotation in both directions. Accordingly, there is a need in the art for an improved lock assembly for a retractable awning.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention relates to a lock mechanism for an awning assembly. In accordance with a first aspect of the present invention a lock mechanism includes a roller tube assembly; and a weather shield provided over at least a portion of the roller tube assembly; wherein the weather shield is selectively engageable with the roller tube assembly to prevent rotation of the roller tube assembly.

In accordance with another aspect of the present invention, a patio awning lock assembly includes a pair of support arms; a roller located between top ends of the support arms; a weather shield provided over a portion of the roller; and a pivot bracket having an angular shape, wherein a first portion of the pivot bracket is rotatably coupled to the weather shield and a second portion of the pivot bracket is fixably coupled to one of the support arms In accordance with yet another aspect of the present invention relates to a patio awning lock mechanism, which includes a roller; a weather shield provided over a portion of the roller; lock means coupled to the roller and operable to rotate with the roller; and engaging means coupled to the weather shield and operable to engage the lock means to retain a patio awning in a retracted or extended position.

To the accomplishment of the foregoing and related ends, the invention then, comprises the features hereinafter fully described. The following description and the annexed drawings set forth in detail certain illustrative aspects of the invention. These aspects are indicative, however, of but a few of the various ways in which the principles of the invention may be employed and the present invention is intended to include all such aspects and their equivalents. Other object, advantages and novel features of the invention will become apparent from the following detailed description of the invention when considered in conjunction with the drawings.

DETAILED DESCRIPTION OF THE PREFERRED EMBODIMENTS OF THE INVENTION

Figure 1:
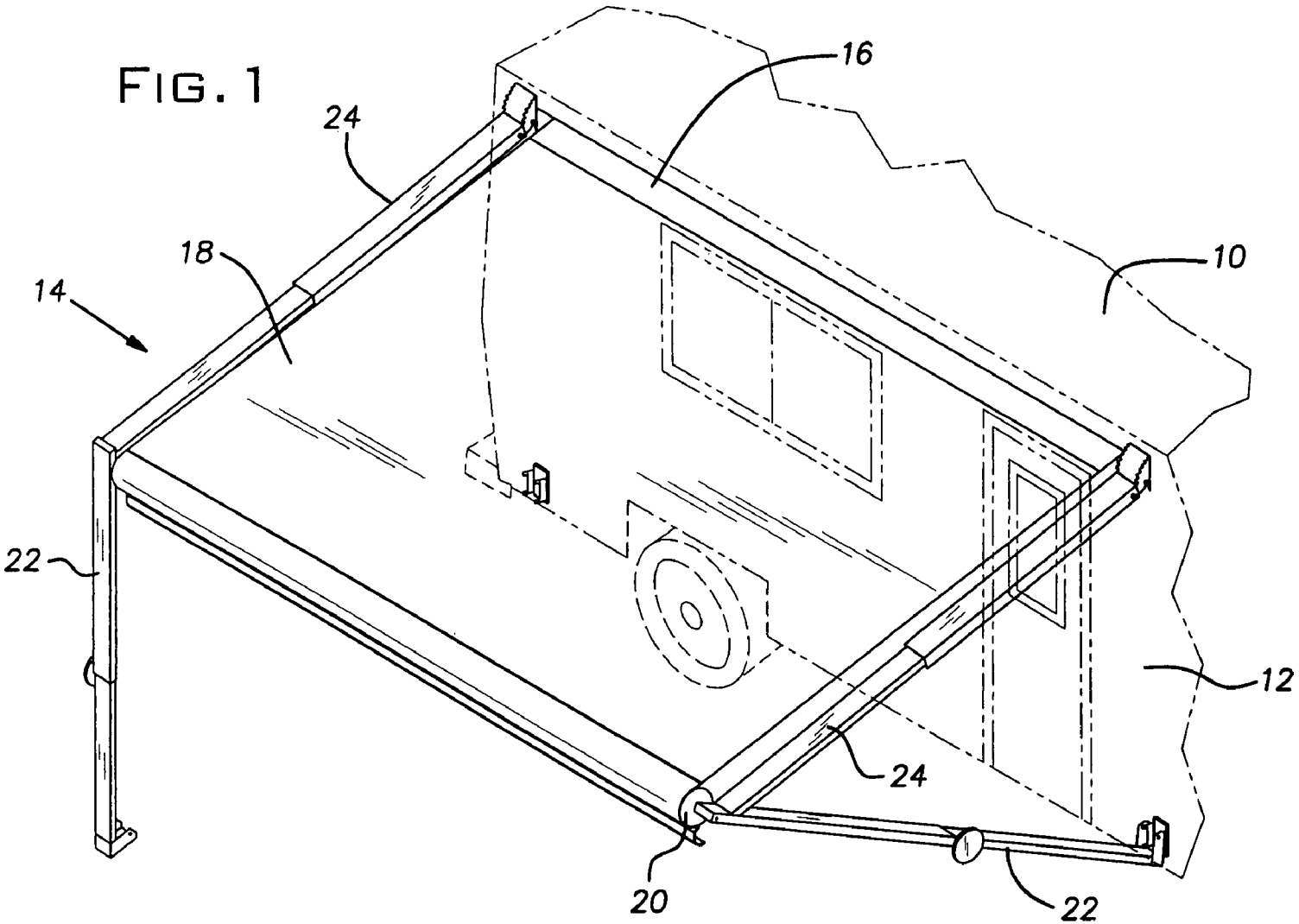
FIG. 1 illustrates a perspective view of a recreational vehicle having an awning assembly in accordance with an aspect of the present invention.

The present invention provides a lock mechanism for a retractable awning assembly. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Referring initially to FIG. 1, a recreational vehicle 10 having a generally vertical sidewall 12 with an awning assembly 14 mounted thereon is illustrated. The awning assembly 14 includes an awning rail 16 mounted on the sidewall 12 and an awning 18 rollable on a roller 20, which can be a roll-formed steel tube. A pair of support arms 22 supports a leading edge of the awning 18; while a trailing edge of the awning 18 is secured to the awning rail 16. The top ends of the support arms 22 are coupled to the ends of the roller 20 and the bottom ends of the support arms 22 are removably mounted on the sidewall 12 or rested on a ground surface. A pair of rafter arms 24 is disposed between the leading and trailing edges of the awning 18 to maintain the awning 18 in tension. The inner ends of the rafter arms 24 are pivotally secured to the awning rail 16 and the outer ends of the rafter arms 24 are pivotally secured to the support arms 22.

The awning assembly 14 can also include a lock mechanism (not shown) provided on one or both end portions of the roller 20. The lock mechanism allows a user to retain the awning assembly 14 in a retracted or extended position. The lock mechanism can be engaged and disengaged via a weather shield, as will be described in further detail below.

Figure 2:
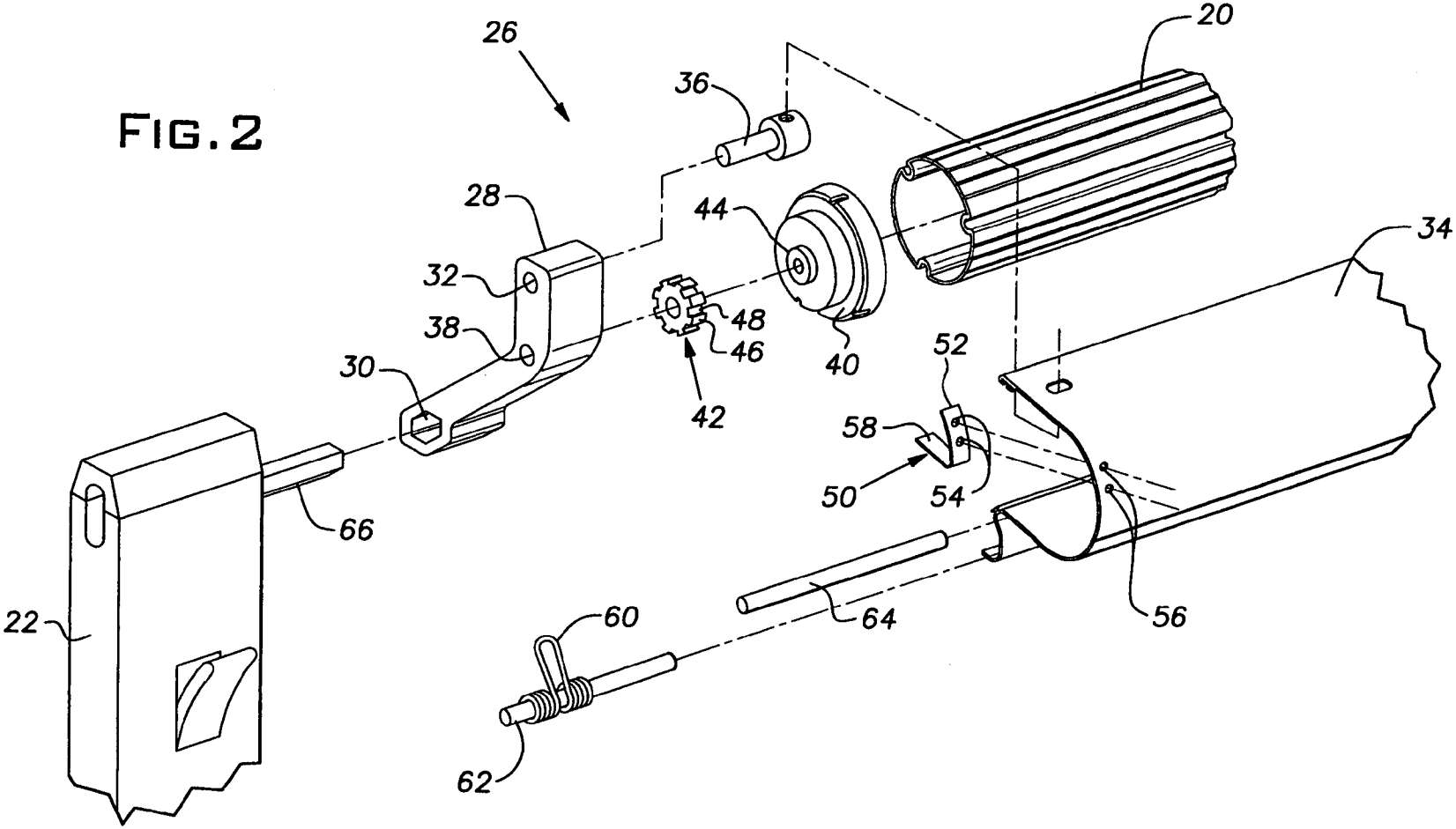
FIG. 2 illustrates an exploded view of a lock mechanism for the awning assembly in accordance with an aspect of the present invention.

FIG. 2 illustrates an exploded view of a lock mechanism 26 that can be employed with awning assembly 14 in accordance with an aspect of the present invention. The lock mechanism 26 includes a pivot bracket 28 located between the roller 20 and one of the support arms 22. The pivot bracket 28 has an angular shape with first and second mounting apertures 30 and 32 located at opposing end portions of the bracket 28. The first mounting aperture 30 is employed to couple the pivot bracket 28 to the support arm 22 in a non-rotatable manner; while the second mounting aperture 32 is employed to rotatably couple the pivot bracket 28 to a weather shield 34 via a pivot rod 36. The weather shield 34 is provided around at least a portion of the roller 20 to protect the awning 18 from environmental effects. Additionally, a third mounting aperture 38 can be located between the first and second apertures 30 and 32 to couple the pivot bracket 28 to the roller to allow the roller 20 to rotate without any rotation of the pivot bracket 28.

The lock mechanism 26 also includes an end cap 40 and a disk gear 42 located between the roller 20 and the pivot bracket 28. The end cap 40 is provided on an end portion of the roller 20 and thus is operable to rotate therewith. The end cap 40 includes a projection 44, which abuts or engages with the disk gear 42, such that the disk gear 42 can rotate with the roller 20 and end cap 40. The disk gear 42 includes a plurality of circumferentially spaced teeth 46 about a periphery thereof. The teeth 46 form a plurality of circumferentially spaced and radially extending stops or abutments 48. It is to be appreciated that the disk gear 42 can be formed integrally with the end cap 40.

The disk gear 42 is selectably engageable with a disk gear catch 50 mounted on the weather shield 34. The disk gear catch 50 includes an arcuate portion 52, which corresponds with a curvature of the weather shield 34. The arcuate portion 52 includes at least one aperture 54 for securing the disk gear catch 50 to at least one aperture 56 in the weather shield 34. The disk gear catch 50 also includes a straight portion 58, which is sized and shaped to engage one of the stops or abutments 48 provided in the disk gear 42. A biasing member 60, such as a spring, is provided to maintain the lock mechanism 26 in a normally locked position. First and second support rods 62 and 64 can also be included for supporting the biasing member 60.

It is to be appreciated that any equivalent of a disk gear and a disk gear catch can be employed in connection with the present invention. For example, the lock mechanism can include a hub with a plurality of apertures and a hub catch to engage one of the plurality of apertures.

Figure 3:
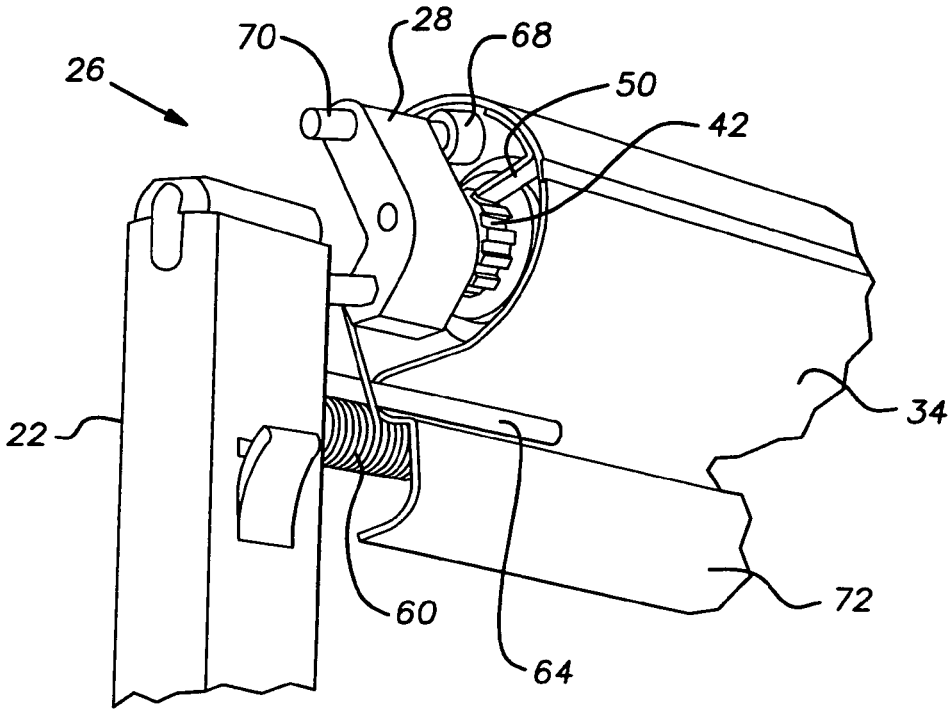
FIG. 3 illustrates a front view of the lock mechanism for the awning assembly in accordance with an aspect of the present invention.
Figure 4:
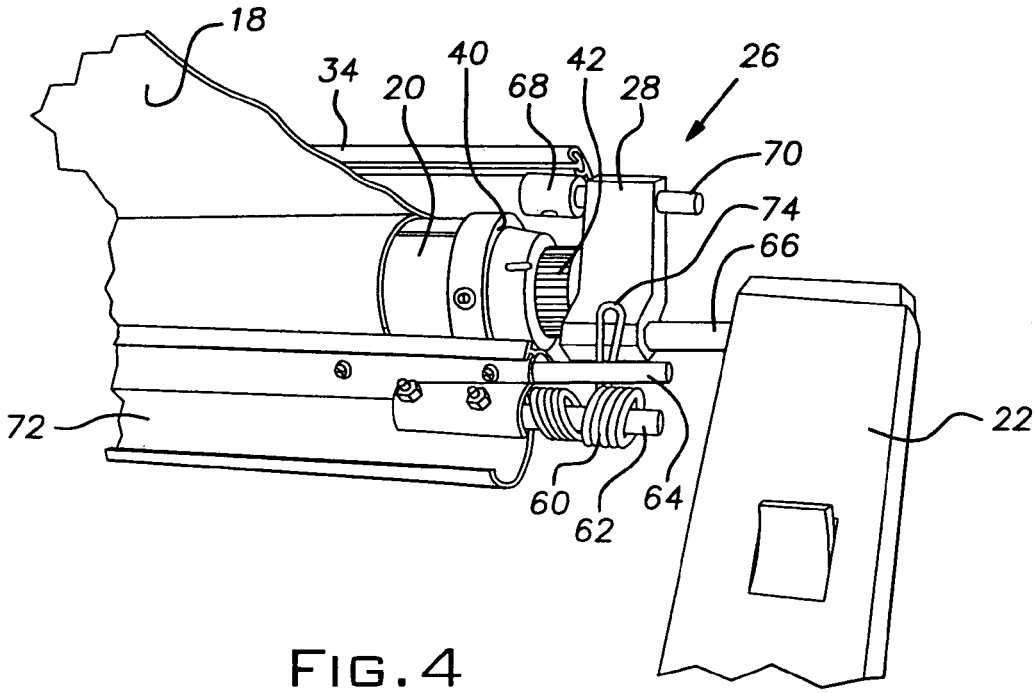
FIG. 4 illustrates a back view of the lock mechanism for the awning assembly in accordance with an aspect of the present invention.

Turning now to FIGS. 3 and 4, the lock mechanism 26, as assembled, is depicted in accordance with an aspect of the present invention. The support arm 22 of the awning assembly 14 is fixably coupled to the first aperture 30 of the pivot bracket 28 via a hex rod 66 or the like. Thus, the pivot bracket 28 does not rotate with respect to the support arm 22. The weather shield 34 is rotatably coupled to the pivot bracket 28 via the pivot rod 36. A first end portion 68 of the pivot rod 36 is secured to an inner top portion of the weather shield 34 such that the pivot rod 36 is fixed with respect to the weather shield 34. A second end portion 70 of the pivot rod 36 has an outer diameter, which is less than a corresponding inner diameter of the second mounting aperture 32, such that the pivot rod 36 is operable to rotate freely within the second aperture 32 of the pivot bracket 28. Thus, because the weather shield 34 is secured to the pivot rod 36, the weather shield is operable to pivot with respect to the pivot bracket 28. A lip portion 72 is provided on the weather shield 34 to facilitate grasping and pivoting of the weather shield 34 by a user.

The end cap 40 is provided over an end portion of the roller 20 and secured thereto via a snap fit, a fastener or any other suitable means. The disk gear 42 is coupled to, or integral with, the end cap 40 such that the roller 20, end cap 40, and disk gear 42 can rotate substantially simultaneously. The disk gear catch 50, which is secured to an inner portion of the weather shield 34, engages the disk gear 42 with a stop or abutment 48. Accordingly, when the disk gear catch 50 is engaged with the disk gear 42, the roller 20 is stopped from rotating.

The torsion spring 60 is supported via a first support rod 62, which is secured to the weather shield 34 via a fastener or the like. The torsion spring 60 includes an extended portion 74, which projects upwards such that the extended portion 74 is situated between the second support rod 64 and the pivot bracket 28. The extended portion 74 of the spring 60 supplies a slight force to the second support rod 64, which in turn, supplies a slight force to a front portion of the weather shield 34 to which the second support rod 64 is coupled. The force applied to the weather shield 34 is sufficient to maintain the weather shield 34 in a position such that the disc gear catch 50 is held in engagement with a disc gear stop 48.

Figure 5:
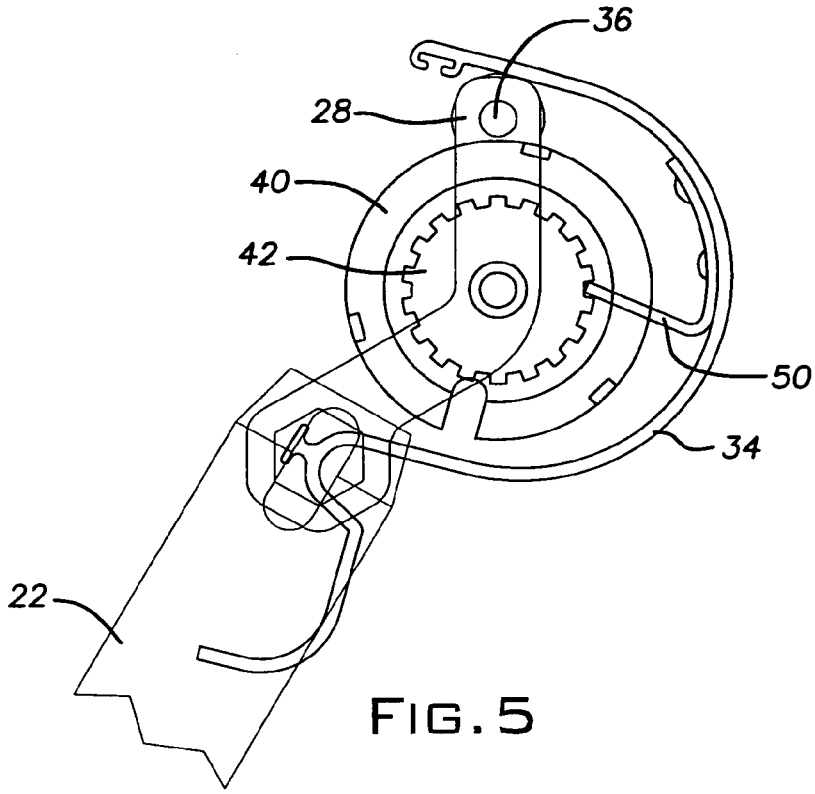
FIG. 5 illustrates the lock mechanism for the awning assembly in a locked position in accordance with an aspect of the present invention.
Figure 6:
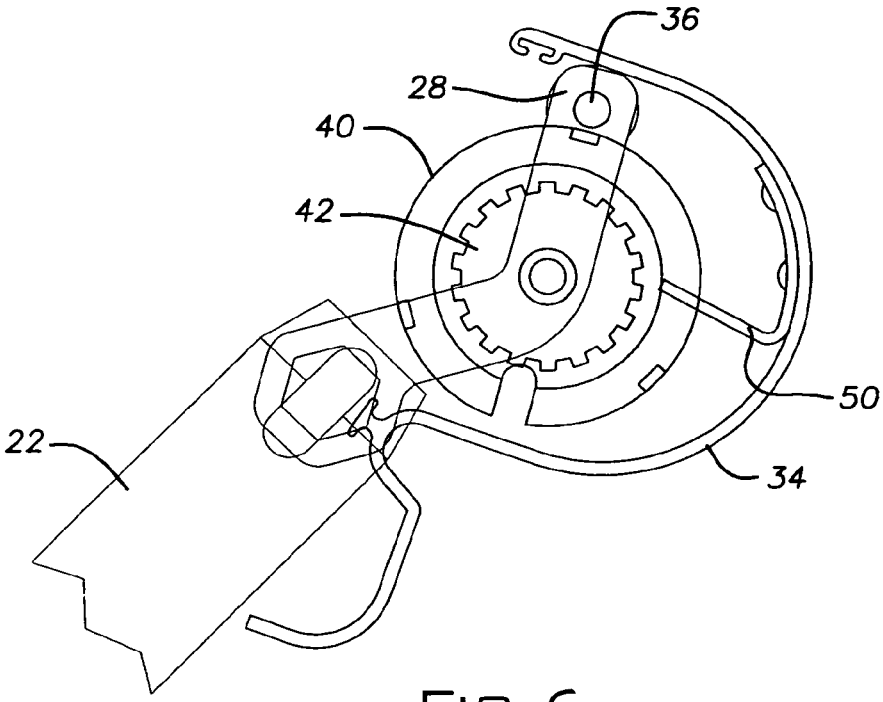
FIG. 6 illustrates the lock mechanism for the awning assembly in an unlocked position in accordance with an aspect of the present invention.

FIGS. 5 and 6 illustrate an operation of the lock mechanism 26 in accordance with an aspect of the present invention. To open the awning 14 (e.g., to extend the fabric to create a sheltered area), a user pulls the lip portion 72 of the weather shield 34 towards the user, such that the pivot rod 36 rotates with respect to the pivot bracket 28. (FIG. 6) This pulling causes the disc gear catch 50 to disengage from the disc gear 42, which disengagement allows the roller tube 20 to rotate and expose the awning fabric 18 as the awning assembly 14 is pulled away from the sidewall 12. When the awning 14 is in a desired position, the weather shield 34 is released. Because the torsion spring 60 biases the disc gear catch 50 toward the disc gear 42, the releasing of the weather shield 34 will cause the disc gear catch 50 to reengage the disc gear 42, thus locking the awning assembly 14 in a desired position. (FIG. 5) To retract the awning 14, the above-described procedure is followed in reverse. Thus, after pulling the weather shield 34 and disengaging the disc gear catch 50, the user will push the awning assembly 14 toward the sidewall 12. Once there, the weather shield 34 is released and the lock is thereby reestablished. The lock mechanism 26 can be employed to releasably secure the awning assembly 14 in a variety of coverage positions relative to the sidewall 12 of the recreational vehicle 10.

Although one lock mechanism 26 has been described herein as being employed on one end of the roller 20, it is to be appreciated that two lock mechanisms 26 can be employed, one on each end of the roller 20, if desired.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A patio awning lock mechanism comprising:

a roller tube assembly; and a weather shield provided over a major portion of the roller tube assembly; and pivotally attached thereto wherein the weather shield is selectively engageable with the roller tube assembly via a lock mechanism that engages and locks a roller tube of the roller tube assembly to prevent rotation of the roller tube assembly.

2. The patio awning lock mechanism of claim 1, further comprising a disk gear coupled to the roller tube assembly.

3. The patio awning lock mechanism of claim 1, further comprising a disk gear catch coupled to the weather shield and selectively engageable with the disk gear to prevent rotation of the roller tube assembly.

4. The patio awning lock mechanism of claim 1, further comprising a pivot bracket rotatably coupled to the weather shield.

5. The patio awning lock mechanism of claim 4, wherein the pivot bracket has an angular shape with first and second mounting apertures located at opposing ends of the pivot bracket.

6. The patio awning lock mechanism of claim 4, further comprising a pivot rod to rotatably couple the pivot bracket to the weather shield.

7. The patio awning lock mechanism of claim 4, wherein the pivot bracket is coupled to a support arm in a non-rotatable manner.

8. The patio awning lock mechanism of claim 4, wherein the pivot bracket is coupled to the roller tube assembly such that the roller tube assembly can rotate without any rotation by the pivot bracket.

9. The patio awning lock mechanism of claim 1, further comprising an end cap provided on an end portion of the roller tube assembly, the end cap having a projection that abuts with a disk gear.

10. The patio awning lock mechanism of claim 9, wherein the disk gear is integrally formed with the end cap.

11. The patio awning lock mechanism of claim 1, further comprising a disk gear having a plurality of circumferentially spaced teeth about a periphery of the disk gear such that a disk gear catch can engage the disk gear at one or more stops formed between the circumferentially spaced teeth.

12. The patio awning lock mechanism of claim 11, wherein the disk gear catch includes a straight portion to engage the disk gear and an arcuate portion that corresponds with a curvature of the weather shield such that the disk gear catch can be secured to the weather shield.

13. The patio awning lock mechanism of claim 1, further comprising a spring to bias the lock mechanism into a locked position.

14. The patio awning lock mechanism of claim 1, wherein the weather shield includes a lip portion to facilitate grasping and pivoting of the weather shield.

15. The patio awning lock mechanism of claim 1, wherein the weather shield comprises a shield configured to protect an awning rollable on the roller tube assembly from environmental effects.

16. A patio awning lock mechanism comprising:

a pair of support arms;

a roller located between top ends of the support arms;

a weather shield provided over a major portion of the roller; and a pivot bracket having an angular shape, wherein a first portion of the pivot bracket is rotatably mounted on the weather shield and a second portion of the pivot bracket is fixably mounted on one of the support arms.

17. The patio awning lock mechanism of claim 16, further comprising a disk gear provided between the pivot bracket and the roller.

18. The patio awning lock mechanism of claim 17, further comprising a disk gear catch secured to the weather shield and operable to engage the disk gear.

19. The patio awning lock mechanism of claim 16, further comprising a torsion spring to bias the pivot bracket and weather shield into a locked position.

20. The patio awning lock mechanism of claim 16, wherein the weather shield includes a lip portion to facilitate grasping and pivoting of the weather shield by a user.

21. The patio awning lock mechanism of claim 16, wherein the weather shield comprises a shield configured to protect an awning rollable on the roller from environmental effects.

22. A patio awning lock mechanism comprising:

a roller;

a weather shield provided over a major portion of the roller;

lock means coupled to the roller and operable to rotate with the roller; and engaging means mounted on the weather shield and operable to engage the lock means to retain a patio awning in a retracted or extended position.

23. The patio awning lock mechanism of claim 22, wherein the weather shield comprises a shield configured to protect an awning rollable on the roller from environmental effects.

* * * * *